US007017566B2

(12) United States Patent
Miwa et al.

(10) Patent No.: US 7,017,566 B2
(45) Date of Patent: Mar. 28, 2006

(54) IGNITION DEVICE FOR AN INTERNAL COMBUSTION ENGINE

(75) Inventors: Tetsuya Miwa, Nagoya (JP); Atsuya Mizutani, Yokkaichi (JP); Takeo Maekawa, Okazaki (JP); Hiromi Hiramatsu, Kariya (JP)

(73) Assignee: Denso Corporation, (JP)

( * ) Notice: Subject to any disclaimer, the term of this patent is extended or adjusted under 35 U.S.C. 154(b) by 1 day.

(21) Appl. No.: 10/397,379

(22) Filed: Mar. 27, 2003

(65) Prior Publication Data

US 2003/0183215 A1 Oct. 2, 2003

(30) Foreign Application Priority Data

Apr. 1, 2002 (JP) ..... 2002-098506

(51) Int. Cl.
*F02P 1/00* (2006.01)

(52) U.S. Cl. ..... 123/634; 123/635; 123/169 PH

(58) Field of Classification Search ..... 123/634, 123/635, 169 PA, 169 PH, 169 CA, 169 E, 123/143 C
See application file for complete search history.

(56) References Cited

U.S. PATENT DOCUMENTS 3,716,813 A * 2/1973 Hillyard ..... 336/60
4,514,712 A * 4/1985 McDougal ..... 336/96
4,825,844 A * 5/1989 Fasola ..... 123/643
5,038,745 A * 8/1991 Krappel et al. ..... 123/635
5,406,921 A * 4/1995 Noble et al. ..... 123/479
6,119,667 A 9/2000 Boyer et al.
6,122,971 A * 9/2000 Wlodarczyk ..... 73/705
6,559,747 B1 * 5/2003 Shimoide et al. ..... 336/96
6,675,785 B1 * 1/2004 Miwa et al. ..... 123/635
2002/0171523 A1 11/2002 Shimoide

FOREIGN PATENT DOCUMENTS

| | | |
|---|---|---|
| EP | 0907019 A2 | 4/1999 |
| EP | 0987435 A2 | 3/2000 |
| JP | 2000-91057 | 3/2000 |
| JP | 2000-208344 | 7/2000 |
| JP | 2000-252040 | 9/2000 |
| JP | 2000-277232 | 10/2000 |

* cited by examiner

*Primary Examiner*—John T. Kwon
(74) *Attorney, Agent, or Firm*—Nixon & Vanderhye PC

(57) ABSTRACT

An insulator includes a plug side cylindrical portion having an inner space for accommodating a center electrode and a coil side cylindrical portion extending in a direction departing from a combustion chamber. The high-voltage portion of an ignition coil is entirely accommodated inside the coil side cylindrical portion. According to this arrangement, the coil side cylindrical portion can assure insulation between the high-voltage portion and the low-voltage portion. The portion to be insulated and fixed by an insulating resin is limited only to the secondary winding.

18 Claims, 4 Drawing Sheets

IGNITION DEVICE FOR AN INTERNAL COMBUSTION ENGINE

BACKGROUND OF THE INVENTION

1. Field of the Invention

The present invention relates to an ignition device for an internal combustion engine which integrally incorporates a spark plug and an ignition coil and also relates to a method for assembling this ignition device.

2. Description of the Background Art

There are various kinds of conventional ignition devices integrally incorporating a spark plug and an ignition coil, which are for example disclosed in Japanese Patent Application Laid-open No. 2000-252040, Japanese Patent Application Laid-open No. 2000-277232 and European Patent Application Laid-open No. 0907019.

However, the conventional ignition devices integrally incorporating a spark plug and an ignition coil are long in length and small in diameter. Therefore, these ignition devices have high internal stresses when subjected to severe heat and cool cycles. To avoid this, adding stress relaxing members is conventionally known to reduce the internal stresses and prevent generation of cracks. Increasing the thickness of an insulating resin layer is also conventionally known as being effective to reduce the stresses. However, these conventional techniques tend to be expensive in the costs required and there will be no substantial margin for actually realizable reduction in the diameter.

Furthermore, the conventional ignition coils were entirely hardened with an insulating resin, such as an epoxy resin or comparable thermosetting resin. Hence, after the ignition coil is once assembled as a finished product, disassembling the ignition coil into individual materials or original members was difficult or substantially impossible. In other words, recycling constituent components or parts of the conventional ignition coils was no practically realized.

SUMMARY OF THE INVENTION

In view of the foregoing problems, the present invention has an object to attain at least one of compactness, cost reduction, and easy recycling for an ignition device for an internal combustion engine.

To accomplish the above and other related objects, the present invention provides a first ignition device for an internal combustion engine, including a spark plug having a center electrode accommodated in a cylindrical insulator made of a ceramic member for generating a spark discharge in a combustion chamber of an internal combustion engine and an ignition coil having a primary winding and a secondary winding for supplying high voltage to the spark plug, wherein the spark plug and the ignition coil are accommodated in a cylindrical casing and installed in a cylinder head of the internal combustion engine, the insulator includes a plug side cylindrical portion having an inner space for accommodating the center electrode and a coil side cylindrical portion extending in a direction departing from the combustion chamber, and the secondary winding is accommodated in the coil side cylindrical portion.

The coil side cylindrical portion can assure insulation between the high-voltage portion and the low-voltage portion. The portion to be insulated and fixed by an insulating resin is limited only to the secondary winding. The ignition device of the present invention does not encounter with the conventional resin crack leak caused by heat and cool cycles. Addition of a stress relaxing member and increasing the thickness of an insulating resin layer are unnecessary. A compact and simple arrangement for the ignition device is realized.

It is preferable for the first ignition device that a high-voltage portion of the ignition coil is entirely accommodated in the coil side cylindrical portion.

Furthermore, the present invention provides a second ignition device for an internal combustion engine including a spark plug having a center electrode accommodated in a cylindrical insulator made of a ceramic member for generating a spark discharge in a combustion chamber of an internal combustion engine and an ignition coil having a primary winding and a secondary winding for supplying high voltage to the spark plug, wherein the spark plug and the ignition coil are accommodated in a cylindrical casing and installed in a cylinder head of the internal combustion engine, the insulator includes a plug side cylindrical portion having an inner space for accommodating the center electrode and a coil side cylindrical portion extending in a direction departing from the combustion chamber, and one of the primary winding and the secondary winding is directly wound around an outer surface of the coil side cylindrical portion.

One of two windings is directly wound around the coil side cylindrical portion. One of conventionally required resin spools can be omitted. The coil side cylindrical portion has excellent heat resistance or thermal durability compared with the conventional resin spool. No heat releasing member is necessary for the resin members. The required costs will be decreased.

It is desirable for the second ignition device that the primary winding is directly wound around the outer surface of the coil side cylindrical portion.

Furthermore, the present invention provides a third ignition device for an internal combustion engine including a spark plug having a center electrode accommodated in a cylindrical insulator made of a ceramic member for generating a spark discharge in a combustion chamber of an internal combustion engine and an ignition coil having a primary winding and a secondary winding for supplying high voltage to the spark plug, wherein the spark plug and the ignition coil are accommodated in a cylindrical casing and installed in a cylinder head of the internal combustion engine, the secondary winding is wound around an outer surface of a cylindrical spool and a center core is accommodated in the spool, and an electrical insulating resin layer is provided on an outer cylindrical surface of the spool while no electrical insulating resin layer is provided on an inner cylindrical surface of the spool.

The center core is not fixed with the electrically insulating resin layer and is therefore disassemblable and separable as a single member and, as a result, is reusable as a recycling material.

It is preferable for the third ignition device that the spool includes a winding cylindrical portion around which the winding is wound and a protruding cylindrical portion protruding in a direction departing from the combustion chamber.

When a resin is poured into the clearance outside the spool, a resin amount is carefully controlled so as not to exceed the position of an open end of the protruding cylindrical portion. This prevents the resin from flowing into the inside of the spool. The resin layer is surely provided only on the outside of the spool.

Furthermore, it is preferable for the third ignition device that the spool has an opening which is closed by a core pressing pad. The core pressing pad can surely prevent the resin from flowing into the inside of the spool.

Furthermore, the present invention provides a fourth ignition device for an internal combustion engine including a spark plug having a center electrode accommodated in a cylindrical insulator made of a ceramic member for generating a spark discharge in a combustion chamber of an internal combustion engine and an ignition coil having a primary winding and a secondary winding for supplying high voltage to the spark plug, wherein the spark plug and the ignition coil are accommodated in a cylindrical casing and installed in a cylinder head of the internal combustion engine, at least one of the casing, the primary winding, and a center core of the ignition coil is disassemblable.

Disassemblable components or parts are separable into individual members and, as a result, are reusable as recycling materials.

It is preferable for the fourth ignition device that the internal member accommodated in the casing is fixed by a bolt screwed into an open end of the casing. The ignition device is easily disassemblable. The casing and the internal members can be separable into individual members and, as a result, are reusable as recycling materials.

Furthermore, the present invention provides a method for assembling an ignition device for an internal combustion engine including a spark plug having a center electrode accommodated in a cylindrical insulator made of a ceramic member for generating a spark discharge in a combustion chamber of an internal combustion engine and an ignition coil having a primary winding and a secondary winding for supplying high voltage to the spark plug, wherein the spark plug and the ignition coil are accommodated in a cylindrical casing and installed in a cylinder head of the internal combustion engine, and the insulator includes a plug side cylindrical portion having an inner space for accommodating the center electrode and a coil side cylindrical portion extending in a direction departing from the combustion chamber. This assembling method includes the steps of hardening the secondary winding with an electrical insulating resin, and inserting the secondary winding into an inner space of the coil side cylindrical portion.

The productivity in the process of impregnating and hardening the secondary winding is improved compared with the case that a secondary spool with the secondary winding wounded around this spool is first inserted into the inside of the coil side cylindrical portion and a resin is injected later. The required costs can be reduced. Furthermore, when the ignition device is disassembled, the secondary spool assembled together with the center core and the secondary winding is easily taken out from the coil side cylindrical portion. Thus, the ignition device can be easily disassembled.

BRIEF DESCRIPTION OF THE DRAWINGS

These and other objects, features, aspects and advantages of the present invention will become more apparent from the following detailed description of the present invention when taken in conjunction with the accompanying drawings, in which.

DESCRIPTION OF THE PREFERRED EMBODIMENTS

Figure 1:
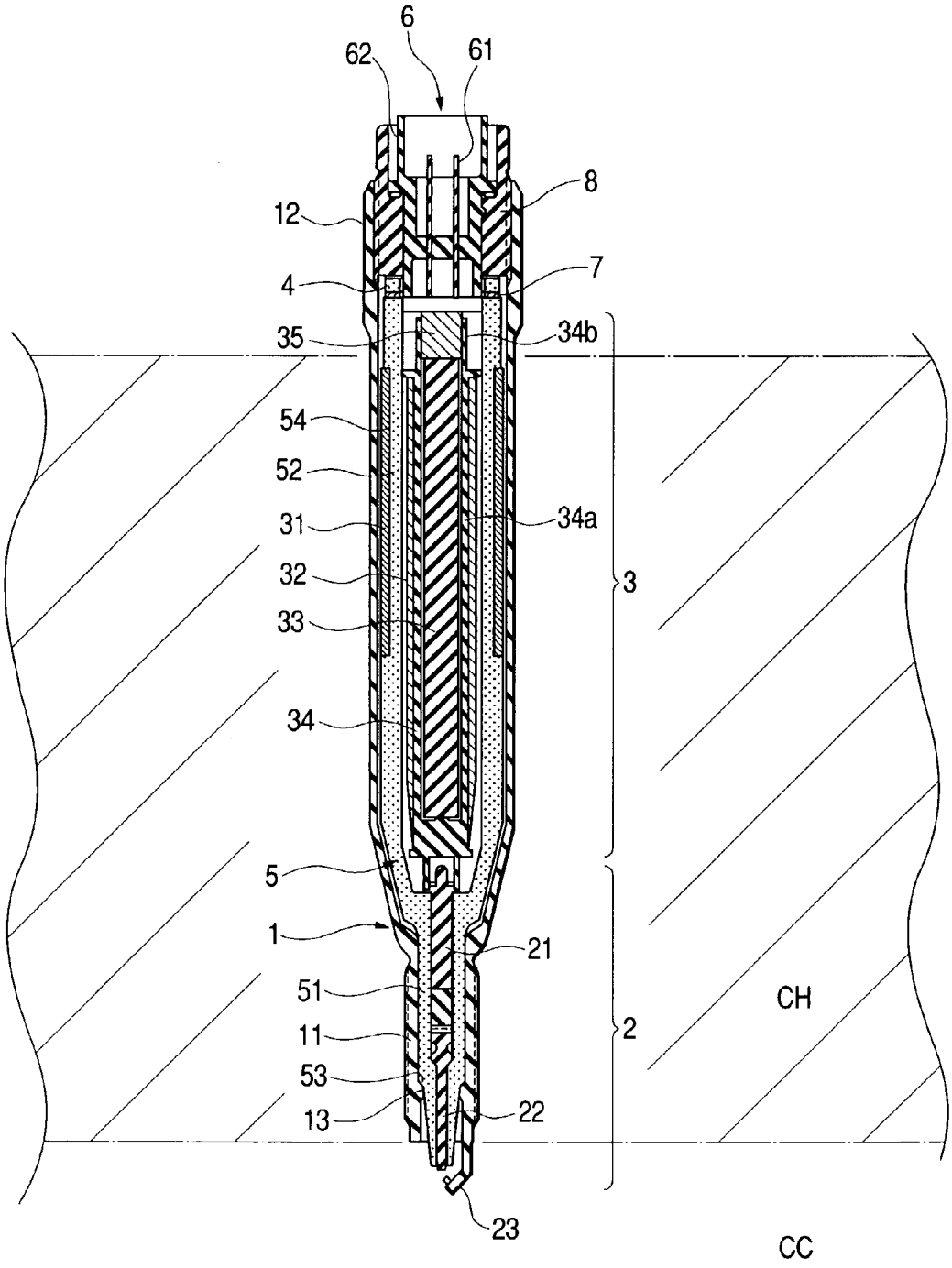
FIG. 1 is a cross-sectional view showing an overall arrangement of an ignition device for an internal combustion engine in accordance with a preferred embodiment of the present invention.
Figure 2:
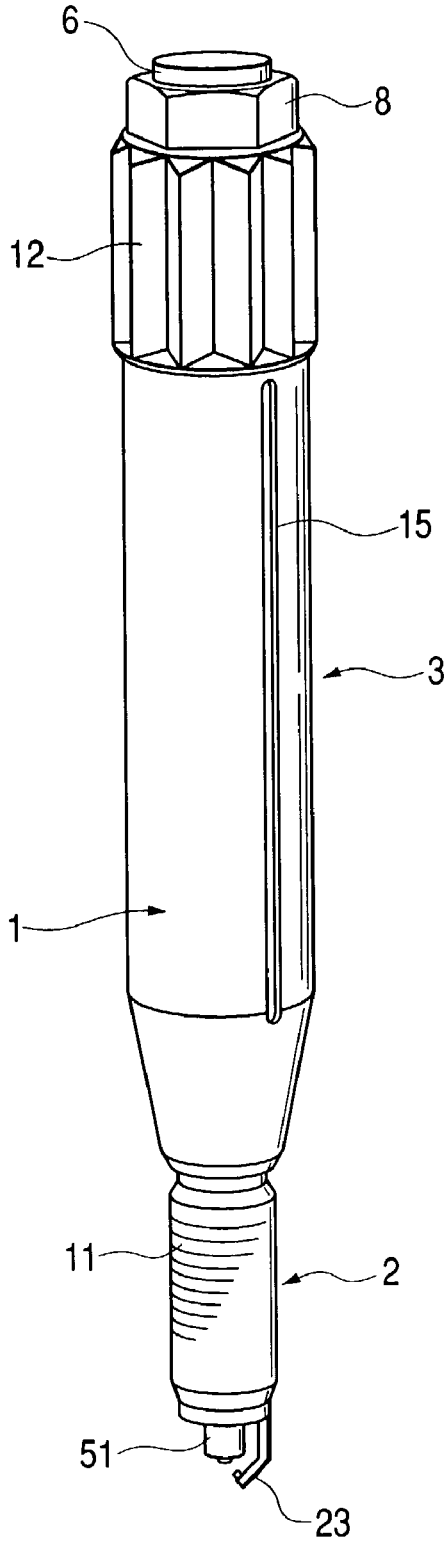
FIG. 2 is a perspective view showing an appearance of the ignition device shown in FIG. 1.
Figure 3:
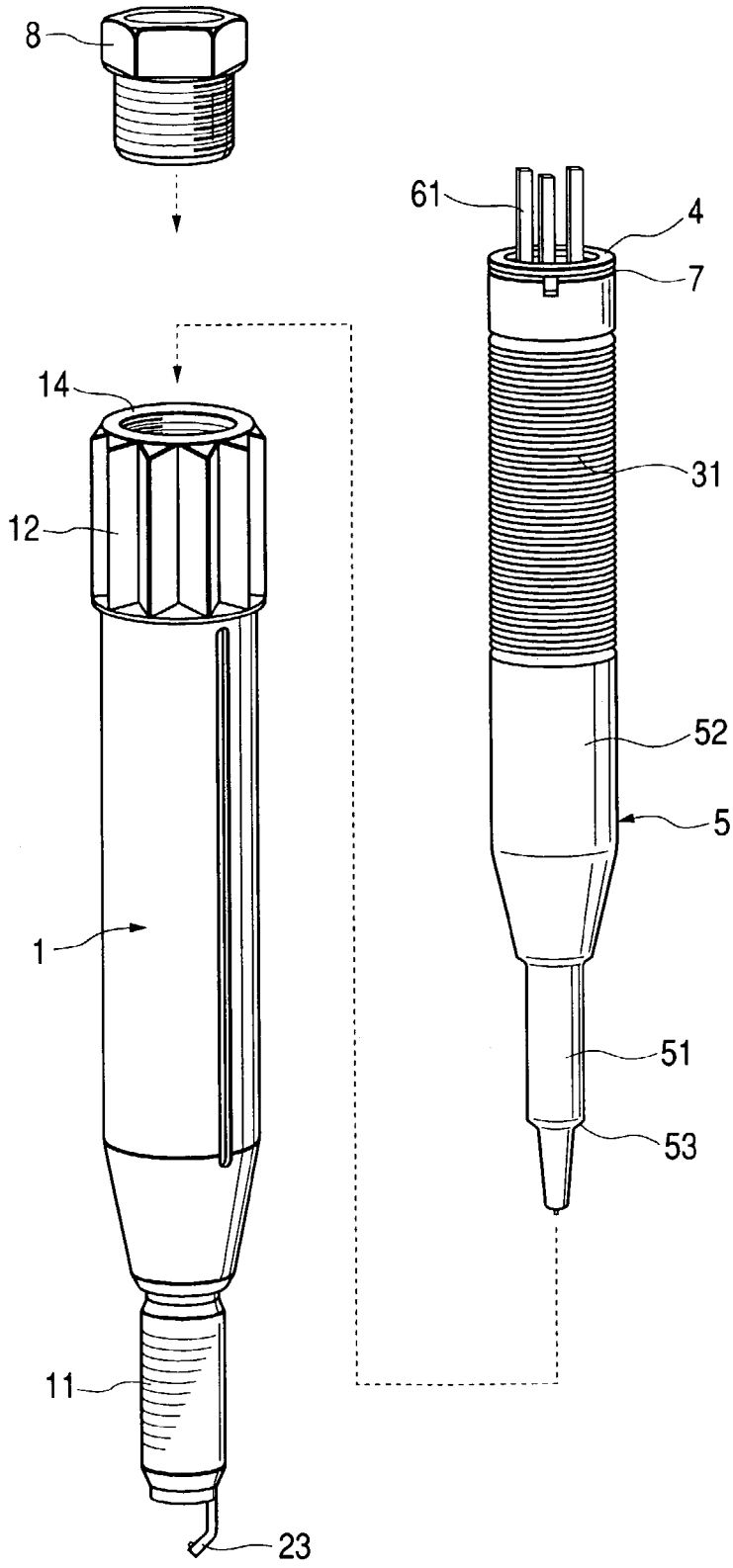
FIG. 3 is an exploded perspective view showing overall assembling of the ignition device shown in FIG. 1.
Figure 4:
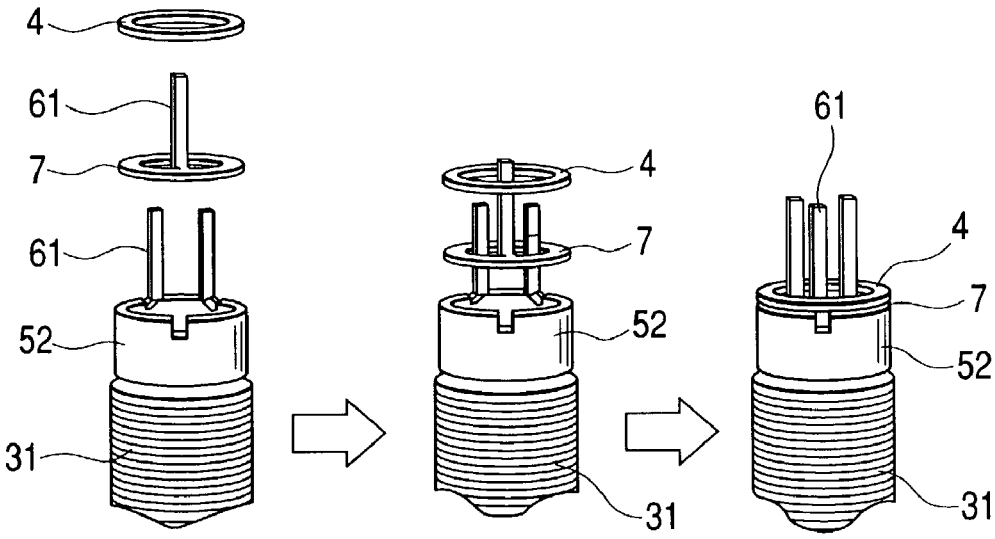
FIG. 4 is a perspective view showing assembling of a pressure sensing element shown in FIG. 1.

FIGS. 1 through 4 are views showing an ignition device for an internal combustion engine in accordance with a preferred embodiment of the present invention. FIG. 1 is a cross-sectional view showing an overall arrangement of the ignition device in accordance with the preferred embodiment of the present invention. FIG. 2 is a perspective view showing an appearance of the ignition device in accordance with the preferred embodiment of the present invention. FIG. 3 is an exploded perspective view showing overall assembling of the ignition device in accordance with the preferred embodiment of the present invention. FIG. 4 is a perspective view showing assembling of a pressure sensing element 4 in accordance with the preferred embodiment of the present invention.

As shown in FIGS. 1 and 2, the ignition device includes a cylindrical casing 1 made of a magnetic and electrically conductive steel member. A spark plug 2, an ignition coil 3 and a pressure sensing element 4 are accommodated or housed in the casing 1. The spark plug 2 is installed in a plug hole of a cylinder head so that both electrodes (described later in more detail) of the spark plug 2 are exposed to a combustion chamber of an automotive internal combustion engine. The cylinder head is roughly indicated by the reference 'CH' in FIG. 1. The combustion chamber is roughly indicated by the reference 'CC' in FIG. 1.

More specifically, an external thread portion 11 is formed on the outer surface of the casing 1 at a predetermined region close to the combustion chamber. Furthermore, a nut portion 12 is formed on the outer surface of the casing 1 at a predetermined region far from the combustion chamber. When the nut portion 12 is rotated by a fastening tool, the casing 1 rotates and advances into a hole of the cylinder head and engages with an internal thread portion formed in this hole (not shown). The ignition device is thus firmly fixed to the cylinder head.

The casing 1 accommodates a cylindrical insulator 5 which is made of an alumina or a comparable ceramic member possessing excellent electrical insulation properties. The insulator 5 includes a plug side cylindrical portion 51, having an inner space for accommodating center electrode 22, and a coil side cylindrical portion 52 extending in a direction departing from the combustion chamber.

The casing 1 has an inner cylindrical surface on which a stepped receiving surface 13 is formed at a region close to the combustion chamber. The plug side cylindrical portion 51 of the insulator 5 has an outer cylindrical surface on which a stepped abutting surface 53 is formed. The stepped abutting surface 53 of the insulator 5 mates with the stepped receiving surface 13 of the casing 1. In other words, when the stepped abutting surface 53 is engaged with the stepped receiving surface 13, the insulator 5 is positioned in the axial direction a predetermined positional relationship with respect to the casing 1. Furthermore, hermetical contact between the stepped abutting surface 53 and the stepped receiving surface 13 serves as a sealing for preventing the combustion gas from leaking out via the clearance between the insulator 5 and the casing 1.

The spark plug 2 includes a stem 21 made of an electrically conductive metal, a center electrode 22 made of an electrically conductive metal, and a ground electrode 23 made of an electrically conductive metal. The stem 21 and the center electrode 22 are accommodated in a center bore axially extending in the plug side cylindrical portion 51 of the insulator 5. One end of the center electrode 22 protrudes into the combustion chamber. The ground electrode 23 is integrally welded to the casing 1. The ground electrode 23 is disposed in a confronting relationship with the protruding end of the center electrode 22.

The ignition coil 3 includes a primary winding 31, a secondary winding 32, a columnar center core which is made of a magnetic member, and a secondary spool 34 which is made of an electrically insulating resin and configured into a cup shape having a bottom.

The primary winding 31, as shown in FIG. 3, is directly wound in a recessed portion 54 on an outer cylindrical surface of the coil side cylindrical portion 52. In this respect, the coil side cylindrical portion 52 serves as a primary spool. Both ends of the primary winding 31 are connected to connector terminals 61 of a connector 6 via terminals (not shown). With this arrangement, the primary winding 31 receives a control signal supplied from an igniter (not shown).

A portion of the casing 1 surrounding the primary winding 31 serves as an external core. As shown in FIG. 2, at least one slit 15 extending in the axial direction is formed on the outer surface of the casing 1 at the region corresponding to the portion surrounding the primary winding 31. This slit 15 prevents the loss to be caused by the ring current generated in response to the change of magnetic flux.

The secondary spool 34 includes a winding cylindrical portion 34*a* for the secondary winding 32 and a protruding cylindrical portion 34*b* which protrudes from the winding cylindrical portion 34*a* in a direction departing from the combustion chamber. The secondary winding 32 is wound around the outer surface of the winding cylindrical portion 34*a*. The secondary spool 34 has a center bore extending in the axial direction thereof for accommodating a center core 33. After the center core 33 is inserted into the center bore of the secondary spool 34, the open end of the secondary spool 34 is closed by a core pressing pad 35. The core pressing pad 35 is made of a rubber, a sponge or a comparable elastic member. Thus, the center core 33 is confined in the secondary spool 34.

After accomplishing the assembling of the secondary spool 34 with the secondary winding 32, the center core 33 and the core pressing pad 35, the secondary spool 34 is inserted into the center bore of the coil side cylindrical portion 52. Then, an electrically insulating resin is injected or poured into an inside space of the insulator 5 from the open end of the coil side cylindrical portion 52 positioned higher, while the insulator 5 is held in an upright position. The injected resin flows into the clearance between the coil side cylindrical portion 52 and the secondary winding 32, and then hardens itself together with the secondary winding 32.

In this case, an injection amount of the resin is carefully controlled so as not to exceed the position of the open end of the protruding cylindrical portion 34*b*. This surely prevents the flowing resin from entering into the center bore of the secondary spool 34. Meanwhile, the core pressing pad 35 has a function of preventing the flowing resin from entering into the center bore of the secondary spool 34. Accordingly, the portion integrally hardened or fixed with the insulating resin is limited only to the secondary winding 32.

In the condition shown in FIG. 1, the high-voltage end of the secondary winding 32 is connected to the center electrode 22 of the spark plug 2. The low-voltage end of the secondary winding 32 is connected to the casing 1 via a terminal (not shown). The casing 1 is grounded to a vehicle body (not shown) via the cylinder head and others.

According to the above arrangement, the coil side cylindrical portion 52 of the insulator 5 completely insulates the high-voltage portion of the ignition coil 3 form the low-voltage portion of the ignition coil 3. In this case, the high-voltage portion includes the secondary winding 32 and the component connecting the stem 21 to the high-voltage end of the secondary winding 32. The low-voltage portion includes the primary winding 31 and the casing 1.

The pressure sensing element 4 produces an output signal whose voltage level varies in accordance with the load applied on this pressure sensing element 4. For example, the pressure sensing element 4 is made of a lead titanate and is configured into a thin ring plate. A terminal 7, positioned next to the pressure sensing element 4, is made of an electrically conductive metal and configured into a thin ring plate. The pressure sensing element 4 and the terminal 7 are disposed next to the open end of the coil side cylindrical portion 52. A connector terminal 61 is integrally formed with the terminal 7 (refer to FIG. 4).

The end of the coil side cylindrical portion 52 is extended upward compared with the position of the primary winding 31 and the secondary winding 32 on the sheet of FIG. 1, so as to secure a space for disposing the pressure sensing element 4 closely to the open end of the coil side cylindrical portion 52. In other words, in the illustration of FIG. 1, the upper end of the coil side cylindrical portion 52 protrudes in the direction departing from the combustion chamber compared with the position of the primary winding 31 and the secondary winding 32.

The casing 1 has an inner cylindrical surface on which an internal thread portion 14 is formed at a region far from the combustion chamber (refer to FIG. 3). A cylindrical bolt 8, serving as a holding member for holding the pressure sensing member 4, has an external thread portion screwed into the opening of the casing 1 and engaged with the internal thread portion 14. The pressure sensing element 4 and the terminal 7 are sandwiched between the open end of the coil side cylindrical portion 52 and the bolt 8.

More specifically, the spark plug 2, the secondary winding 32, the center core 33, and the secondary spool 34 are assembled into the inside space of insulator 5 under the condition that the primary winding 31 is wound around the outer surface of the insulator 5. Then, as shown in FIG. 4, the terminal 7 and the pressure sensing element 4 are successively placed on the open end of the coil side cylindrical portion 52. Next, as shown in FIG. 3, the assembly of the insulator 5 is inserted into the casing 1. Then, the bolt 8 is screwed into the open end of the casing 1 and tightened with the internal thread portion 14 of the casing 1, thereby firmly depressing the pressure sensing element 4, the terminal 7, and the insulator 5 to the receiving surface 13.

Fastening the bolt 8 in this manner brings an effect of giving a compression preload on the pressure sensing element 4 and also brings an effect of providing a hermetical contact between the receiving surface 13 and the abutting surface 53 of the insulator 5 so as to prevent the combustion gas from leaking out via the clearance between the casing 1 and the insulator 5.

One end of the pressure sensing element 4 is electrically connected to the casing 1 via the bolt 8. The other end of the pressure sensing element 4 is connected to the terminal 7. Via these electrical paths, the output signal of the pressure sensing element 4 is sent to a control device (not shown).

After the bolt 8 is tightened with the internal thread portion 14, a resin casing 62 of the connector 6 is inserted into the inner bore of the bolt 8 from the outside.

According to the ignition device having the above-described arrangement, the ignition coil 3 generates high voltage in response to a control signal supplied from the igniter. When the high voltage is applied between the electrodes, the spark plug 2 generates a spark discharge in a discharge gap formed between the electrodes so as to ignite the gas mixture confined in the combustion chamber. The combustion of gas mixture in the combustion chamber generates a pressure which is transmitted to the pressure sensing element 4 via the insulator 5. Thus, the pressure sensing element 4 receives a compression load representing the combustion pressure. Then, the pressure sensing element 4 produces the output signal having a voltage level corresponding to the detected load.

According to the above-described embodiment, the open end of the coil side cylindrical portion 52 protrudes in the direction departing from the combustion chamber compared with the position of the primary winding 31 and the secondary winding 32. The pressure sensing element 4 is disposed next to the open end of the coil side cylindrical portion 52. Therefore, the signal lines of the pressure sensing element 4 can be taken out of the casing 1 without passing aside the ignition coil 3. Hence, without increasing the diameter of the casing 1, it becomes possible to prevent the output signal of the pressure sensing element 4 from being adversely influenced by discharge noises generated from the ignition coil 3. There is no necessity of employing complicated layout for the signal lines.

Furthermore, the compression preload is given to the pressure sensing element 4 by tightening the bolt 8. This makes it possible to assure output accuracy with respect to the pressure variation in the combustion chamber.

Furthermore, tightening the bolt 8 brings the effect of pressing the abutting surface 53 of the insulator 5 to the receiving surface 13 of the casing 1. Hence, it becomes possible to provide a hermetical contact between the receiving surface 13 of the casing 1 and the abutting surface 53 of the insulator 5 for preventing the combustion gas from leaking out via the clearance between the casing 1 and the insulator 5.

As apparent from the above-described preferred embodiment, the present invention provides a first ignition device for an internal combustion engine including a spark plug (2) having a center electrode (22) accommodated in a cylindrical insulator (5) made of a ceramic member for generating a spark discharge in a combustion chamber of an internal combustion engine and an ignition coil (3) having a primary winding (31) and a secondary winding (32) for supplying high voltage to the spark plug (2), wherein the spark plug (2) and the ignition coil (3) are accommodated in a cylindrical casing (1) and installed in a cylinder head of the internal combustion engine, the insulator (5) includes a plug side cylindrical portion (51) having an inner space for accommodating the center electrode (22) and a coil side cylindrical portion (52) extending in a direction departing from the combustion chamber, and the secondary winding (32) is accommodated in the coil side cylindrical portion (52).

According to a preferable embodiment of the present invention, it is preferable for the first ignition device that a high-voltage portion of the ignition coil (3) is entirely accommodated in the coil side cylindrical portion (52).

The primary winding (31) is disposed on the outer surface of the coil side cylindrical portion (52). All of the high-voltage components including the secondary winding (32) are accommodated in the inside space of the coil side cylindrical portion (52). Thus, the coil side cylindrical portion (52) of the insulator (5) surely insulates the high-voltage portion from the low-voltage portion. The component to be insulated and fixed by an insulating resin is limited only to the secondary winding (32). Hence, the ignition device of this invention does not encounter with the conventional resin crack leak caused by heat and cool cycles. Addition of a stress relaxing member and increasing the thickness of an insulating resin layer are unnecessary. A compact and simple arrangement for the ignition device can be realized.

Furthermore, the present invention provides a second ignition device for an internal combustion engine including a spark plug (2) having a center electrode (22) accommodated in a cylindrical insulator (5) made of a ceramic member for generating a spark discharge in a combustion chamber of an internal combustion engine and an ignition coil (3) having a primary winding (31) and a secondary winding (32) for supplying high voltage to the spark plug (2), wherein the spark plug (2) and the ignition coil (3) are accommodated in a cylindrical casing (1) and installed in a cylinder head of the internal combustion engine, the insulator (5) includes a plug side cylindrical portion (51) having an inner space for accommodating the center electrode (22) and a coil side cylindrical portion (52) extending in a direction departing from the combustion chamber, and one of the primary winding (31) and the secondary winding (32) is directly wound around an outer surface of the coil side cylindrical portion (52).

According to this arrangement, one of two windings (31, 32) is directly wound around the coil side cylindrical portion (52) of the insulator (5) which is made of a ceramic member. For example, the primary winding (31) is directly wound around the outer surface of the coil side cylindrical portion (52). In other words, the insulator (5) serves as a primary spool. Accordingly, the conventionally used resin-made primary spool can be omitted. Furthermore, as the insulator (5) has excellent heat resistance compared with the conventional resin-made primary spool, no heat releasing member is necessary for the resin members. The required costs will be decreased.

Furthermore, the present invention provides a third ignition device for an internal combustion engine including a spark plug (2) having a center electrode (22) accommodated in a cylindrical insulator (5) made of a ceramic member for generating a spark discharge in a combustion chamber of an internal combustion engine and an ignition coil (3) having a primary winding (31) and a secondary winding (32) for supplying high voltage to the spark plug (2), wherein the spark plug (2) and the ignition coil (3) are accommodated in a cylindrical casing (1) and installed in a cylinder head of the internal combustion engine, the secondary winding (32) is wound around an outer surface of a cylindrical spool (34) and a center core (33) is accommodated in the spool (34), and an electrical insulating resin layer is provided on an outer cylindrical surface of the spool (34) while no electrical insulating resin layer is provided on an inner cylindrical surface of the spool (34).

According to this arrangement, the center core (33) is not fixed with the electrically insulating resin layer and is therefore disassemblable and separable as a single member and, as a result, is reusable as a recycling material.

According to a preferable embodiment of the third ignition device, the spool (34) includes a winding cylindrical portion (34*a*) around which the winding is wound and a protruding cylindrical portion (34*b*) protruding in a direction departing from the combustion chamber.

According to this arrangement, during the injection of a resin poured into the clearance outside the spool (34), a resin injection amount is controlled so as not to exceed the position of an open end of the protruding cylindrical portion (34*b*). With this control, it becomes possible to prevent the resin from flowing into the inside of the spool (34). As a result, the resin layer can be surely provided only on the outside of the spool (34). The portion to be insulated and fixed by the resin is limited only to the secondary winding (32).

Furthermore, it is preferable for the third ignition device that the spool (34) has an opening which is closed by a core pressing pad (35).

According to this arrangement, the core pressing pad (35) can surely prevent the resin from flowing into the inside of the spool (34). Hence, it becomes possible to provide the resin layer only on the outside of the spool (34).

Furthermore, the present invention provides a fourth ignition device for an internal combustion engine including a spark plug (2) having a center electrode (22) accommodated in a cylindrical insulator (5) made of a ceramic member for generating a spark discharge in a combustion chamber of an internal combustion engine and an ignition coil (3) having a primary winding (31) and a secondary winding (32) for supplying high voltage to the spark plug (2), wherein the spark plug (2) and the ignition coil (3) are accommodated in a cylindrical casing (1) and installed in a cylinder head of the internal combustion engine, at least one of the casing (1), the primary winding (31), and a center core (33) of the ignition coil (3) is disassemblable.

According to this arrangement, disassemblable components or parts are separable into individual members and, as a result, are reusable as recycling materials.

According to the preferred embodiment of the fourth ignition device, it is preferable that an internal member accommodated in the casing (1) is fixed by a bolt (8) screwed into an open end of the casing (1).

According to this arrangement, the internal members accommodated in the casing (1) can be fixed by the bolt (8). The ignition device is easily disassemblable. Hence, the casing (1) and the internal members are separable into individual members and, as a result, are reusable as recycling materials.

As the internal members accommodated in the casing (1) are fixed by the bolt (8), the fixing using resin charging or the adhesive material is no longer required. Thus, the ignition device can be easily disassembled. The metallic components, such as the casing (1), the bolt (8), the primary winding (31), the center core (33), and the connector output terminal (61), are separable into individual members and accordingly reusable as recycling materials.

Furthermore, the present invention provides a method for assembling an ignition device for an internal combustion engine including a spark plug (2) having a center electrode (22) accommodated in a cylindrical insulator (5) made of a ceramic member for generating a spark discharge in a combustion chamber of an internal combustion engine and an ignition coil (3) having a primary winding (31) and a secondary winding (32) for supplying high voltage to the spark plug (2), wherein the spark plug (2) and the ignition coil (3) are accommodated in a cylindrical casing (1) and installed in a cylinder head of the internal combustion engine, and the insulator (5) includes a plug side cylindrical portion (51) having an inner space for accommodating the center electrode (22) and a coil side cylindrical portion (52) extending in a direction departing from the combustion chamber. This assembling method includes the steps of hardening the secondary winding (32) with an electrical insulating resin, and inserting the secondary winding (32) into an inner space of the coil side cylindrical portion (52).

According to this method, productivity in the process of impregnating and hardening the secondary winding can be improved compared with the case that a secondary spool with the secondary winding wounded around this spool is first inserted into the inside of the coil side cylindrical portion and a resin is injected later. The required costs can be reduced. Furthermore, when the ignition device is disassembled, the secondary spool assembled together with the center core and the secondary winding can be easily taken out from the coil side cylindrical portion. Thus, the ignition device can be easily disassembled.

The reference numerals in parentheses attached to above-described means show the correspondence to practical parts or components disclosed in the above-described embodiments.

Various Modifications

According to the above-described embodiment, the secondary winding 32 is located inside and the primary winding 31 is located outside with respect to the cylindrical insulator 5. However, the present invention is not limited to the disclosed layout. For example, it is possible to reverse the positional relationship so that the secondary winding 32 is located outside and the primary winding 31 is located inside with respect to the cylindrical insulator 5.

Furthermore, according to the above-described embodiment, tightening of the bolt 8 is employed to give a preload on the pressure sensing element 4. It is however possible to replace the bolt 8 with a holding member having no screw which can be press-fitted into the casing 1. Alternatively, after a holding member is inserted in the casing, it is possible to fix the holding member by caulking so that a predetermined preload is applied on the pressure sensing element 4. Moreover, it is possible to weld the holding member to the casing 1 under the condition that the holding member is inserted in the casing 1 with a preload applied on the pressure sensing element 4.

Furthermore, according to the above-described embodiment, a resin is injected after the secondary spool 34 and other internal components are inserted into the center bore of the coil side cylindrical portion 52. However, it is possible to harden the secondary winding 32 with an electrically insulating resin under the condition that the secondary winding 32 is wound around the secondary spool 34 and then insert the hardened assembly of the secondary winding 32 and the secondary spool 34 into the center bore of the coil side cylindrical portion 52.

According to this arrangement, compared with the case that a resin is injected, the productivity in the process of impregnating and hardening the secondary winding 32 can be improved. The required costs can be reduced. Furthermore, when the ignition device is disassembled, the secondary spool 34 assembled together with the secondary winding 32 and the center core 33 can be easily taken out from the coil side cylindrical portion 52.

What is claimed is:

1. An ignition device for an internal combustion engine, comprising a spark plug having a center electrode accommodated in a cylindrical insulator made of a ceramic material for generating a spark discharge in a combustion chamber of an internal combustion engine and an ignition coil having a primary winding and a secondary winding for supplying high voltage to the spark plug, wherein said spark plug and said ignition coil are accommodated in a cylindrical casing and installed in a cylinder head of said internal combustion engine, said insulator comprises a plug side cylindrical portion having an inner space for accommodating said center electrode and a coil side cylindrical portion extending in a direction departing from said combustion chamber, said secondary winding is accommodated in said coil side cylindrical portion, and said plug side cylindrical portion and said coil side cylindrical portion are made of the same ceramic material.

2. The ignition device for an internal combustion engine in accordance with claim 1, wherein a high-voltage portion of said ignition coil is entirely accommodated in said coil side cylindrical portion.

3. An ignition device for an internal combustion engine, comprising a spark plug having a center electrode accommodated in a cylindrical insulator made of a ceramic material for generating a spark discharge in a combustion chamber of an internal combustion engine and an ignition coil having a primary winding and a secondary winding for supplying high voltage to the spark plug, wherein said spark plug and said ignition coil are accommodated in a cylindrical casing and installed in a cylinder head of said internal combustion engine, said insulator comprises a plug side cylindrical portion having an inner space for accommodating said center electrode and a coil side cylindrical portion extending in a direction departing from said combustion chamber, one of said primary winding and said secondary winding is directly wound around an outer surface of said coil side cylindrical portion, and said plug side cylindrical portion and said coil side cylindrical portion are made of the same ceramic material.

4. The ignition device for an internal combustion engine in accordance with claim 3, wherein said primary winding is directly wound around the outer surface of said coil side cylindrical portion.

5. An ignition device for an internal combustion engine, comprising a spark plug having a center electrode accommodated in a cylindrical insulator made of a ceramic material for generating a spark discharge in a combustion chamber of an internal combustion engine and an ignition coil having a primary winding and a secondary winding for supplying high voltage to the spark plug, wherein said spark plug and said ignition coil are accommodated in a cylindrical casing and installed in a cylinder head of said internal combustion engine, said secondary winding is wound around an outer surface of a cylindrical spool and a center core is accommodated in said spool, an electrical insulating resin layer is provided on an outer cylindrical surface of said spool while no electrical insulating resin layer is provided on an inner cylindrical surface of said spool, said ceramic insulator comprises a plug side portion having an inner space for receiving the center electrode and a coil side portion extending away from said combustion chamber and accommodating at least a portion of said ignition coil, and said plug side cylindrical portion and said coil side cylindrical portion being made of the same ceramic material.

6. The ignition device for an internal combustion engine in accordance with claim 5, wherein said spool comprises a winding cylindrical portion around which said winding is wound and a protruding cylindrical portion protruding in a direction departing from said combustion chamber.

7. The ignition device for an internal combustion engine in accordance with claim 5, wherein said spool has an opening which is closed by a core pressing pad.

8. An ignition device for an internal combustion engine, comprising a spark plug having a center electrode accommodated in a cylindrical insulator made of a ceramic material for generating a spark discharge in a combustion chamber of an internal combustion engine and an ignition coil having a primary winding and a secondary winding for supplying high voltage to the spark plug, wherein said spark plug and said ignition coil are accommodated in a cylindrical casing and installed in a cylinder head of said internal combustion engine, at least one of said casing, said primary winding, and a center core of said ignition coil is disassemblable, wherein said ceramic insulator includes a plug side portion having an inner space for accommodating said center electrode and a coil side portion accommodating at least a portion of said ignition coil, wherein said secondary winding is accommodated in said coil side portion.

9. The ignition device for an internal combustion engine in accordance with claim 8, wherein an internal member accommodated in said casing is fixed by a bolt screwed into an open end of said casing.

10. An ignition device for an internal combustion engine, comprising:

a spark plug for generating a spark discharge in a combustion chamber of the internal combustion engine, said spark plug including a center electrode and an insulator made of a ceramic material;

an ignition coil having a primary winding and a secondary winding for supplying high voltage to the spark plug;

wherein said ceramic insulator comprises a plug side portion having an inner space for accommodating said center electrode and a coil side portion extending in a direction away from said combustion chamber to accommodate at least a portion of said ignition coil.

11. The ignition device for an internal combustion engine in accordance with claim 10, wherein said secondary winding of said ignition coil is accommodated in said coil side portion of said ceramic insulator.

12. The ignition device for an internal combustion engine in accordance with claim 10, wherein a high-voltage portion of said ignition coil is entirely accommodated in said coil side portion.

13. The ignition device for an internal combustion engine in accordance with claim 10, wherein said primary winding is directly wound around the outer surface of said coil side portion.

14. The ignition device for an internal combustion engine in accordance with claim 10, wherein said spark plug and said ignition coil are accommodated in a common cylindrical casing and installed in a cylinder head of said internal combustion engine.

15. The ignition device for an internal combustion engine in accordance with claim 5, wherein said ceramic insulator includes a plug side portion having an inner space for accommodating said center electrode and a coil side portion accommodating at least a portion of said ignition coil.

16. The ignition device for an internal combustion engine in accordance with claim 15, wherein said secondary winding is accommodated in said coil side cylindrical portion.

17. The ignition device for an internal combustion engine in accordance with claim 1, wherein said plug side cylindrical portion and said coil side cylindrical portion are integrated as one body.

18. The ignition device for an internal combustion engine in accordance with claim 5, wherein said primary winding is directly wound around an outer surface of said coil side cylindrical portion.

* * * * *